United States Patent [19]

Bowes

[11] Patent Number: 4,928,918

[45] Date of Patent: May 29, 1990

[54] PRINTER AND STAND ASSEMBLY

[75] Inventor: William A. Bowes, Kettering, Ohio

[73] Assignee: Eastman Kodak Company, Rochester, N.Y.

[21] Appl. No.: 350,864

[22] Filed: May 12, 1989

[51] Int. Cl.[5] ..... E21F 17/02

[52] U.S. Cl. ..... 248/688; 248/165; 248/676

[58] Field of Search ..... 248/163.1, 676, 165, 248/166, 150, 153, 175, 97, 188, 918, 440.1, 688, 176; 108/153, 154, 155, 157; 400/613.2, 691, 613.3

[56] References Cited

U.S. PATENT DOCUMENTS

| | | | |
|---|---|---|---|
| 1,441,824 | 1/1923 | Billings | 248/440.1 |
| 2,400,807 | 5/1946 | Burkhard | 248/221.4 |
| 2,520,795 | 8/1950 | Bramming | 248/221.4 X |
| 2,628,141 | 2/1953 | Scheuer | 108/157 |
| 2,877,973 | 3/1959 | Carlson | 108/157 X |
| 2,926,442 | 3/1960 | Reimel | 248/221.4 X |
| 4,175,841 | 11/1979 | LaPorte | 354/5 |
| 4,651,967 | 3/1987 | McCoy | 248/676 |
| 4,707,156 | 11/1987 | Clark | 400/613.2 X |
| 4,722,506 | 2/1988 | Chang | 400/613.2 X |
| 4,840,344 | 6/1989 | Moroe | 248/676 |

*Primary Examiner*—J. Franklin Foss
*Attorney, Agent, or Firm*—John D. Husser

[57] ABSTRACT

An improved printer/stand assembly includes a printer having four bottom wall recesses and two U-shaped stand members. The ends of the stand members are sized to interfit loosely within the bottom wall recesses. The span between the stand ends is greater or less than their recess spacing. When the legs are spread or compressed to interfit into their recesses, the interconnector bottom of each member deflects to provide (i) a restoring holding force and (ii) a point contact interface with the rest surface.

5 Claims, 3 Drawing Sheets

PRINTER AND STAND ASSEMBLY

FIELD OF INVENTION

The present invention relates to an assembly wherein a printer is supported by a stand to allow a continuous print media input stack to be located therebeneath and, more particularly, to the construction of such an assembly wherein leg members interfit with the printer bottom wall.

BACKGROUND ART

In order to minimize the desk or counter space needed by a printer system (i.e. the printer and its print media), it is known in the art to place the printer on an elevating stand that provides a space for a continuous print media supply to rest beneath the printer. U.S. Pat. No. 4,651,967 discloses one such prior art printer stand, which comprises a four-legged table construction formed of interconnected metal wire portions that can be folded to a collapsed condition. The '967 patent print stand is a separate component from the printer, such stands often being purchased separately by printer-owners that desire their capabilities. Stands such as taught by the '967 patent are intended to be moved discretely from the printer, from place-to-place around the office, i.e. they are not attached to the printer. Also, the fabrication of printer stands such as disclosed in the '967 patent is relatively complicated.

SUMMARY OF INVENTION

A significant purpose of the present invention is to provide a printer/stand assembly wherein the stand can be obtained separately, as needed by the printer-owner, and thereafter easily attached to the printer for movement therewith as a single unit. Another important purpose of the present invention is to provide such a printer/stand system wherein the stand is inexpensive to fabricate and easy to assemble and disassemble from the printer, while providing a sturdy and stable printer support with underneath media storage.

In one aspect, the present invention constitutes an improved printer/stand assembly comprising: (i) a printer having a generally rectangular bottom housing wall with leg recesses formed in each corner; and (ii) a pair of U-shaped members forming opposing leg portions and an interconnector portion. Each of the leg portions has ends that are sized to loosely fit into the leg recesses. The interconnector portion of each of the U-shaped members is deflectable and the span between the leg ends is slightly less or greater than the spacing between opposite housing wall recesses. When the ends of the leg portions are spread and fit into the recesses, they are retained by member restoring forces and such deflection configures at least one interconnector portion forms into a concave-down shape, providing point-type contact to a support surface.

BRIEF DESCRIPTION OF THE DRAWINGS

The subsequent description of preferred embodiments refers to the accompanying drawings wherein.

DETAILED DESCRIPTION OF PREFERRED EMBODIMENTS

Figure 2:
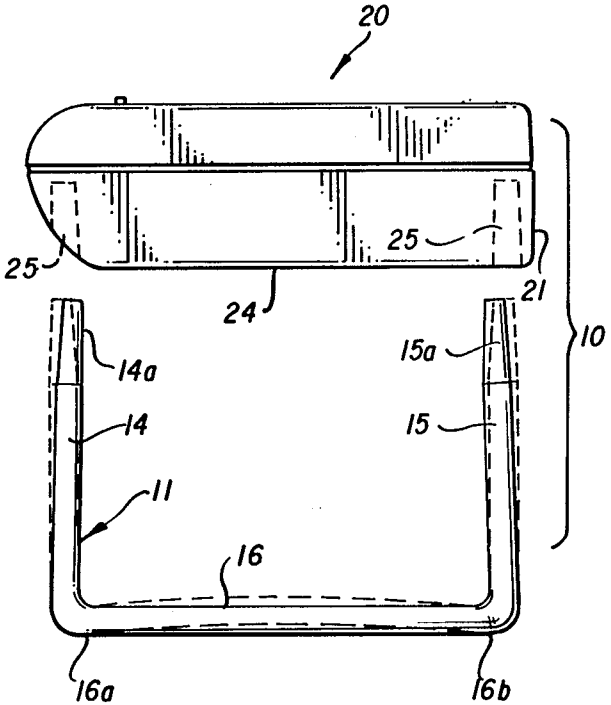
FIGS. 1 and 2 are respectively front and side views of one printer/stand system embodiment in accord with the present invention.
Figure 1:
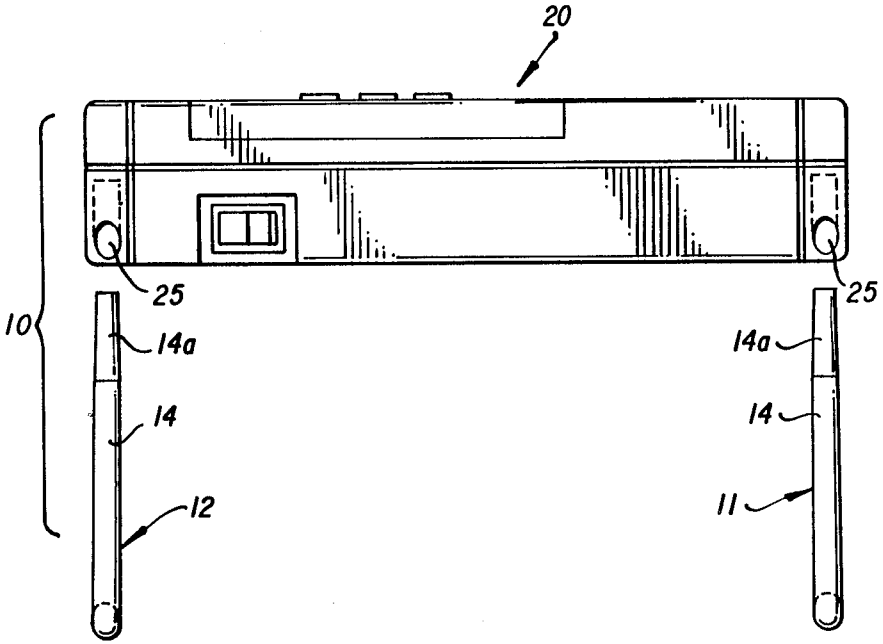
Figure 3:
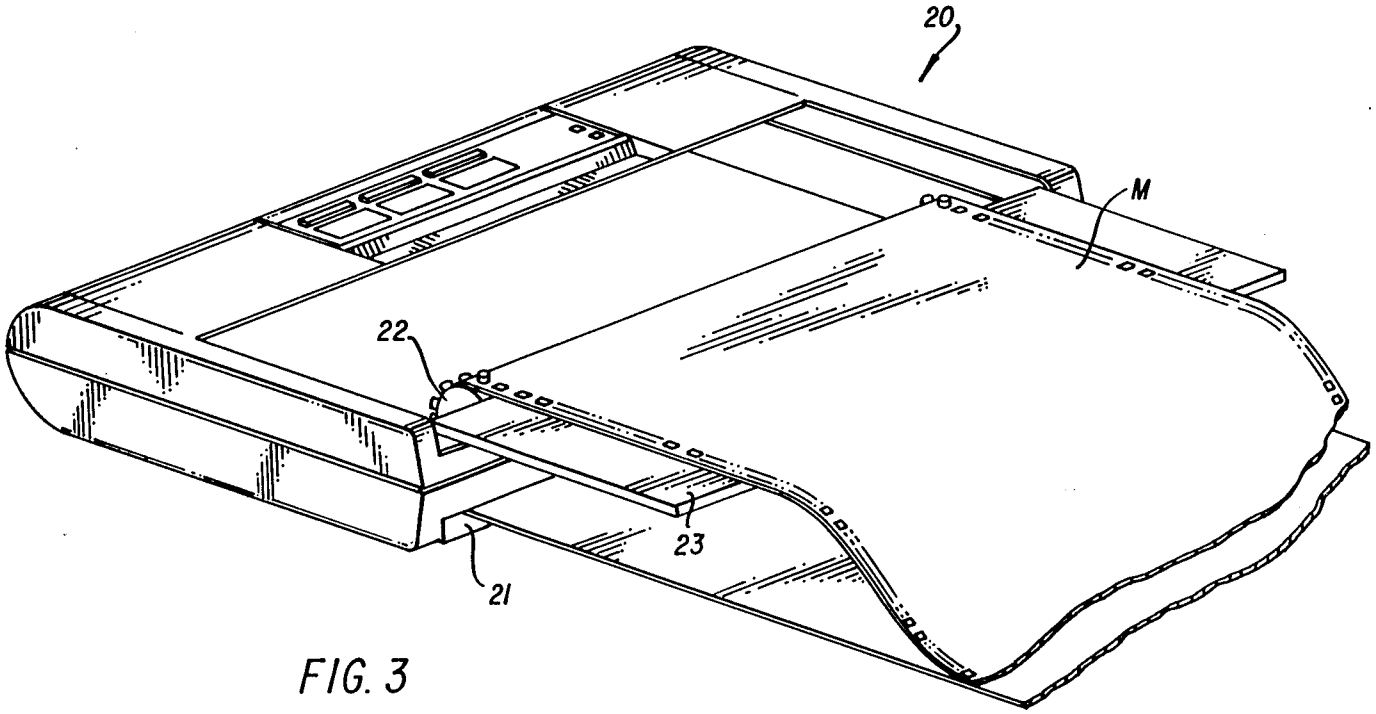
FIG. 3 is a perspective view of a FIG. 1 printer in a continuous media mode of operation.

FIGS. 1 and 2 illustrate one preferred printer/stand assembly 10 in accord with the present invention. In general, the assembly comprises a printer 20 and U-shaped members 11, 12 that are constructed to interfit in a unique manner with the printer 20. The printer itself can be a stand-alone unit such as described, for example, in U.S. Pat. No. 4,759,646, and, as shown in FIG. 3 is adapted to receive sheet or continuous fanfold media M via a bottom rear ingress 21, feed it through a print zone via platen 22 and discharge the print media at the top of the printer. A printer top lid member 23 can be provided to guide output media beyond the printer ingress 21 to prevent refeed.

Referring back to FIGS. 1 and 2, it can be seen that the printer 20 has recesses 25 formed proximate corner regions of its bottom wall 24. The recesses 25 are predeterminedly sized to be slightly larger in cross-section than the leg end portions of the stand members 11, 12 which they receive, for purposes that will become apparent in the subsequent description.

As mentioned, each of stand members 11 and 12 has a U-shape configuration comprising upstanding leg portions 14, 15 and an interconnector bottom portion 16. The bottom portion 16 is formed of a material and cross section that allows flexure, e.g. from a position generally perpendicular to the leg portions to the bowed position shown by dotted lines in FIG. 2. More specifically when the tops of legs 14, 15 are spread apart the bottom portion of a member flexes to a concave down configuration that yields two point-type contact zones **16*a*, 16*b*** rather than the line contact surface profile shown in solid.

The top ends **14*a*, 15*a*, of leg portions 14, 15 are each sized in cross-section to fit loosely within the recesses 25 of printer 20 and the span between the top ends, in the unflexed (solid line) condition, is less than the spacing between the recesses. However, the legs can be spread by flexure of the bottom portion (to the dotted line position) to align with the recesses 25 and then their ends are easily inserted into those recesses. When released the resilient restoring force of bottom portion 16 causes the ends to pinch against the inner recess sides and thus retain the members 11 and 12 in firm attachment to the printer 20. The members 11, 12 comprising the stand portion can be easily detached from the printer by reflexing their top portions to a spread condition and withdrawing their ends from recesses 25**.

The members 11, 12 can be readily fabricated from molded plastic and are therefore not costly. They can be easily attached and detached from the printer by the user and when in place are easily moved with the printer from one location to another. In use, the point-type zones **16*a*, 16*b*** provide a stable support for the printer and the space provided between the stand members accommodate an input stack of print media.

Figure 5:
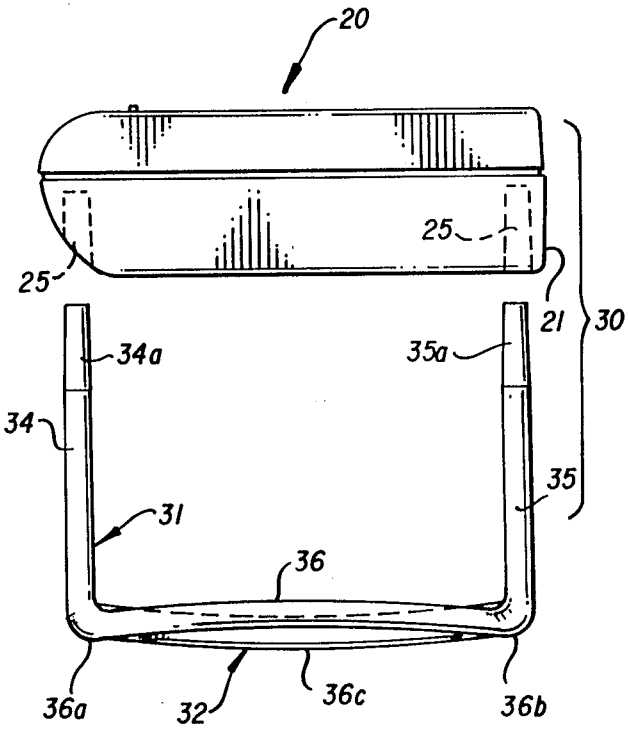
FIGS. 4 and 5 are respectively front and side views of another printer/stand embodiment in accord with the present invention.
Figure 4:
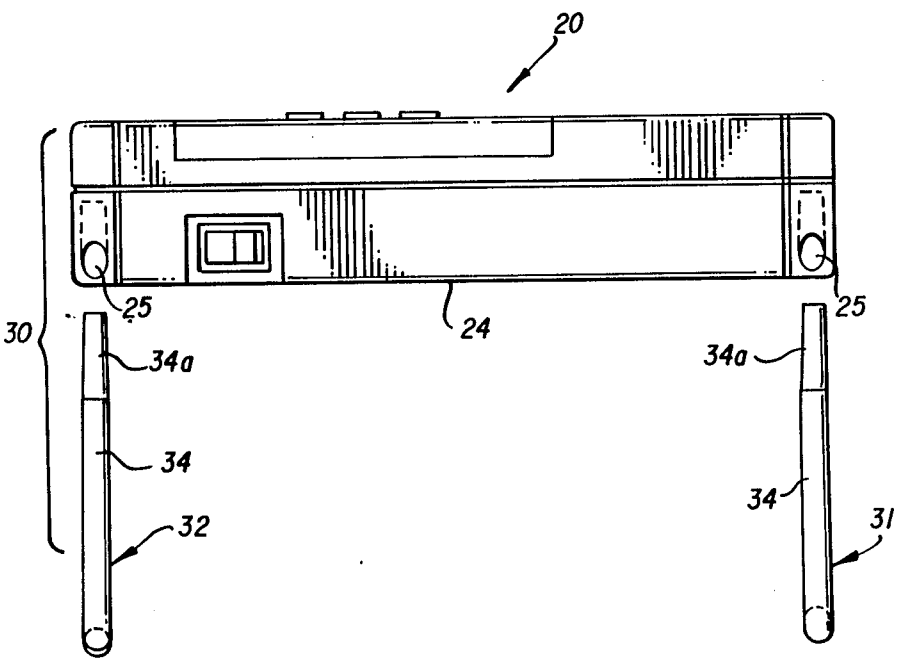

FIGS. 4 and 5 show another embodiment of the present invention constructed to provide a three-point support condition. In this embodiment printer 20 and a U-shape member 31 are constructed and assembled as described with respect to FIG. 1 and 2. However, U-shape member 32 is constructed so that the span between its top ends **34*a*, 35*a* is greater than the printer spacing between printer recesses. To attach member 32, its legs 34, 35 are flexed together slightly (rather than spread) and its top ends 34***a*, 35*a* inserted into recesses 25. In this instance, the spreading restoring force of the interconnector member 36 urges the top ends 34*a*, 35*a* into firm engagement with the outer edges of the recesses to retain the stand. The flexed, convex-down bottom surface of member 32 provides a third point region 36*c* to cooperate with the regions 36*a* and 36*b* on the flexed, concave-down portion of member 31 to provide the advantage of 3 (instead of 4) point support. This embodiment has the disadvantage over the FIG. 1 embodiment of requiring different U-shape members or different hole spacings. However, the FIG. 4, 5 embodiment has the advantage of the more stable 3-point base, that does not rock.

The invention has been described in detail with particular reference to certain preferred embodiments thereof, but it will be understood that variations and modifications can be effected within the spirit and scope of the invention. For example, the upstanding leg portions can be constructed at a slightly acute angle to the interconnector (rather than perpendicular). In such embodiment, spreading to a normal vis a vis the printer bottom yields a concave configuration to the interconnector. Also, the printer recesses need not be in corners of the printer bottom, nor be located along parallel line loci. That is, it may be preferred to have stand members slant outwardly from front to rear of the printer in their mounted position.

I claim:

1. An improved printer/stand assembly comprising:

(a) a printer having a bottom wall with two pairs of spaced, opposing leg recesses formed therein; and (b) two U-shaped members comprised of substantially linear opposing leg portions and substantially linear interconnector portion, each of said leg portions having ends that are sized to loosely fit into said leg recesses, the interconnector portion of each of said members being deflectable and the span between said leg portion ends being sufficiently less than the spacing between the centers of opposing leg recesses that when said leg portions are spread and fit into said leg recesses, the U-shape members are retained by member restoring forces and the deflection of their interconnector portions form into a concave-down configuration for providing support surface, point-type contact regions proximate each leg-interconnector portions juncture.

2. An improved printer/stand assembly comprising:

(a) a printer having a generally rectangular bottom having a wall with leg recesses formed in corner regions thereof; and (b) a pair of U-shaped members, each comprising substantially linear opposing leg portions and a substantially linear interconnector portion, each of said leg portions having ends that are sized to loosely fit into said leg recesses, the interconnector portion of each of said members being deflectable and the span between said leg portion ends of at least one of said U-shaped members being slightly less than the spacing between opposite housing wall recesses, whereby said ends of said one leg portion, when spread and fit into said recesses, are retained by member restoring forces and the deflection of its interconnector portion forms into a concave-down configuration for providing point-type surface contact regions proximate each leg-interconnector portions juncture.

3. The invention defined in claim 2 wherein the span between the leg portion ends of said other U-shaped member is slightly greater than the spacing between opposite housing wall recesses whereby its ends when compressed together and fit into said wall recesses are retained by member restoring forces and the deflection of its interconnector portion forms into a convex-down configuration for providing a point-type surface contact region proximate the midpoint of said interconnector portion.

4. The invention defined in claim 1 wherein said U-shaped members are molded plastic fabrications.

5. The invention defined in claim 2 wherein said U-shaped members are molded plastic fabrications.

* * * * *